US005803338A

United States Patent [19]

Singer et al.

[11] Patent Number: 5,803,338

[45] Date of Patent: Sep. 8, 1998

[54] FASTENER DRIVING TOOL FOR LOCATING A PRE-EXISTING HOLE IN A FIRST WORKPIECE AND DRIVING A FASTENER THERETHROUGH INTO A SECOND WORKPIECE

[75] Inventors: Edward H. Singer; Charles J. Moorman, both of Cincinnati; Peter Hirt, Mason, all of Ohio

[73] Assignee: Senco Products, Inc., Cincinnati, Ohio

[21] Appl. No.: 753,552

[22] Filed: Nov. 26, 1996

[51] Int. Cl.[6] ..... B25C 1/04

[52] U.S. Cl. ..... 227/8; 227/110; 227/119; 227/130; 227/136

[58] Field of Search ..... 227/7, 8, 10, 107, 227/119, 110, 120, 116, 123, 130, 132, 135, 136, 142

[56] References Cited

U.S. PATENT DOCUMENTS

| | | | |
|---|---|---|---|
| 2,982,595 | 5/1961 | Rogers, Jr. | 227/130 |
| 3,157,884 | 11/1964 | Decot et al. | 227/130 |
| 3,891,133 | 6/1975 | Maier et al. | 227/136 |
| 4,375,867 | 3/1983 | Novak et al. | 227/109 |
| 4,485,952 | 12/1984 | Weis | 227/32 |
| 4,610,381 | 9/1986 | Kramer et al. | 227/7 |
| 4,671,443 | 6/1987 | Becht | 227/109 |
| 4,856,696 | 8/1989 | Seld | 227/8 |
| 4,928,867 | 5/1990 | Jensen | 227/32 |
| 5,052,607 | 10/1991 | Dutton | 227/119 |
| 5,193,730 | 3/1993 | Tanaka et al. | 227/8 |
| 5,238,167 | 8/1993 | Howard et al. | 227/32 |
| 5,452,835 | 9/1995 | Shkolnikov | 227/32 |
| 5,484,094 | 1/1996 | Gupta | 227/142 |

FOREIGN PATENT DOCUMENTS

| | | |
|---|---|---|
| 3243018 | 11/1983 | Germany . |
| 4433746 | 3/1995 | Germany . |

*Primary Examiner*—Scott A. Smith
*Attorney, Agent, or Firm*—Jerrold J. Litzinger

[57] ABSTRACT

A fastener driving tool capable of locating a preformed hole in a first workpiece and driving a nail therethrough and into a second workpiece to attach the first workpiece to the second workpiece. The tool comprises a body having a main portion and a handle portion, a guide body, a drive track in the guide body, a driver axially shiftable in the drive track, a fastener containing magazine, a magazine cover, a manual trigger, and a trigger enabling safety. The magazine cover is supported by the guide body and the handle portion of the tool and contains the magazine. The magazine communicates with the drive track and is supported by a slide captively mounted on the guide body and axially shiftable therealong. The magazine is shiftable within the magazine cover in directions parallel to the drive track axis between a lower position wherein the forwardmost fastener in the drive track extends below the nose of the guide body serving as a hole finding probe, and an upper position wherein the safety, attached to the sleeve, enables the trigger and the guide body nose rests upon the first workpiece with the drive track aligned with the pre-formed hole and the tool is ready to be actuated by the trigger.

22 Claims, 13 Drawing Sheets

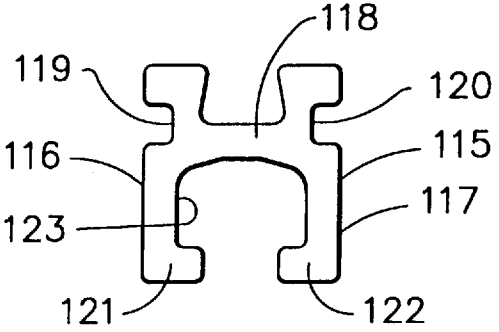
FIG. 25
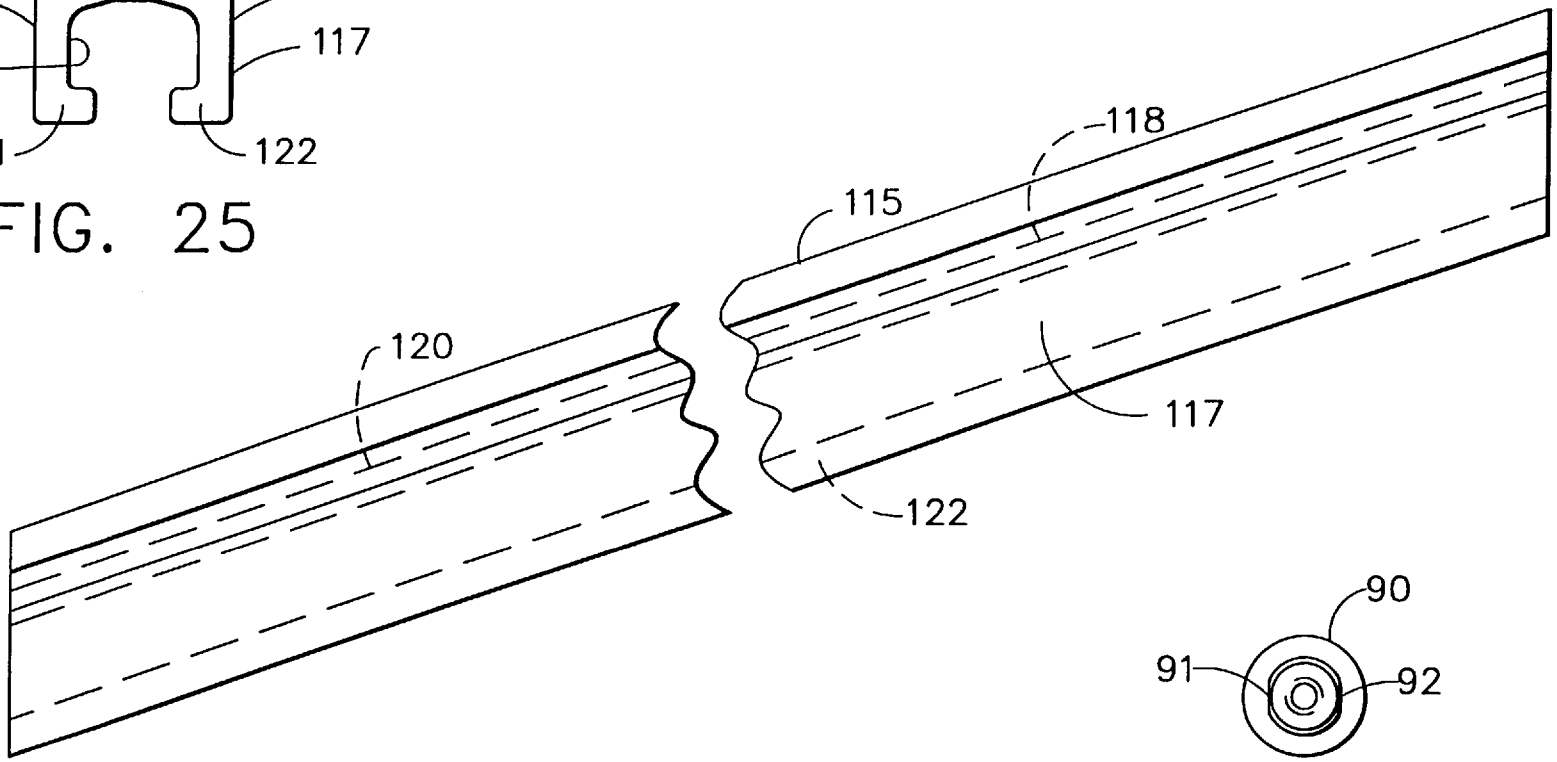
FIG. 26
FIG. 27

FASTENER DRIVING TOOL FOR LOCATING A PRE-EXISTING HOLE IN A FIRST WORKPIECE AND DRIVING A FASTENER THERETHROUGH INTO A SECOND WORKPIECE

TECHNICAL FIELD

The invention relates to a fastener driving tool for locating a pre-existing hole in a first workpiece and for driving a fastener through the hole and into a second workpiece, and more particularly to such a tool having a magazine with a fastener carrying portion which is shiftable in directions parallel to the drive track axis between a first position wherein the forwardmost fastener can locate and enter the hole and a second position wherein the forwardmost fastener can be driven through the hole and into the second workpiece.

BACKGROUND ART

Prior art workers have devised many types of powered, hand-held, fastener driving tools. The tools can be designed to drive various types of fasteners such as nails, staples, blind rivets, and the like. The driver of the fastener driving tool may be driven by compressed air, internal combustion means, or electrical means such as a solenoid, or a flywheel assembly. The present invention is applicable to such fastener driving tools, and is not specifically limited to the types of fasteners being driven or the drive means of the tool. For purposes of an exemplary showing, the invention will be described in terms of its application to a pneumatic fastener driving tool designed to drive nails.

The invention is appropriate to any situation wherein a first workpiece is to be attached to a second workpiece, the first workpiece having a pre-existing hole through which the nail is to be driven into the second workpiece, to join the workpieces together. Fastener driving tools in general, and nailers in particular, are fairly large, bulky tools comprising a main body portion, a handle portion, a fastener magazine portion and a guide body. The guide body contains the drive track for the nails, the forwardmost nail in the magazine being driven out of the drive track by a piston powered driver. The lowermost part of the guide body, generally referred to as the tool nose portion, is such that it would be substantially impossible to accurately line up the drive track of the tool with a pre-existing hole in a workpiece, the pre-existing hole having a diameter to just nicely receive the shank of a nail.

One of the most common instances where this problem arises is found in the attachment of metallic brackets to wooden structural frame members to join the structural frame members together in a fixed relationship with respect to each other. The brackets are normally formed of sheet metal or plate. If the drive track of a nailer is not properly aligned with a pre-formed nail hole in the metallic bracket, the bracket will not be properly attached to the wooden workpiece and it could also further result in deformation of the forwardmost nail, which might become jammed in the drive track.

Prior art workers have attempted to solve this problem in a number of ways. U.S. Pat. No. 4,928,867 teaches the use of metallic brackets or connectors which have particular formations formed therein in conjunction with each hole. These may constitute inner and outer raised rings on the metallic connector surrounding a nail hole and forming a groove therebetween, an arcuate raised ridge, a series of tabs, or the like. The fastener driving tool has an alignment foot which coacts with these formations to align the drive track with the nail hole in the connector or bracket.

U.S. Pat. No. 5,193,730 teaches a pneumatic nailer provided with a nail push piston mechanism which separates the forwardmost nail from the strip thereof and extends the forwardmost nail below the nailers' nose portion. A nail holding mechanism firmly engages the body portion of the nail, maintaining the nail in its protruding position so that it can be used to find a hole. Once so positioned, the nail is driven in place, the holding mechanism releasing the nail.

U.S. Pat. No. 5,238,167 teaches a nailer having a probe by which proper alignment of the drive track and a pre-existing hole is achieved. The probe is moved out of the way by the nail during the driving thereof.

In co-pending application Ser. No. 08/424,831, filed Apr. 19, 1995, in the name of Charles J. Moorman, and entitled FASTENER DRIVING TOOL FOR LOCATING A PRE-EXISTING THROUGH HOLE IN A WORKPIECE AND DRIVING A FASTENER THERETHROUGH, an otherwise standard pneumatic nailer is provided with a modified guide body and a modified magazine. The magazine is made up of an inner magazine portion which carries a strip of nails. The inner magazine portion is surrounded by an outer magazine portion attached to the handle portion of the pneumatic nailer and the guide body. The inner magazine portion is pivoted at its rearward end within the outer magazine portion and is shiftable between a first position wherein the forwardmost nail of a strip is extended beyond the nose sufficiently to enable the forwardmost nail to act as a probe and to locate and enter the preformed nail hole through which it is to be driven, and a second position wherein the forwardmost nail of the strip remains in the hole and is positioned to be driven. Once the hole is located, the tool is pressed toward the workpiece causing the inner magazine portion to achieve its second position. The inner magazine portion is operatively connected to a safety trip which, when the inner magazine portion is shifted from its first position to its second position, shifts with it from a first trigger disabling position to a second trigger enabling position, so that the nail may be driven by the nailer. The inner magazine portion and the trip are biased to their first positions. This is basically a simpler and less complicated approach which requires no special probe, no special means to separate the forwardmost nail from the nail strip, and no special configurations on the first workpiece which has the preformed hole.

The present invention is based upon the discovery that if a sleeve is captively mounted on the guide body and is shiftable therealong in directions along the drive track axis, and if the magazine is mounted on the sleeve and is shiftable therewith, an even simpler tool can be provided which does not involve pivoted motion of the magazine.

DISCLOSURE OF THE INVENTION

According to the invention there is provided a fastener driving tool which is not only capable of ordinary fastener driving use, but is also designed to locate and align a pre-formed hole in a first workpiece with the drive track of the tool. Once the workpiece hole has been located and aligned with the drive track, the fastener driving tool is pressed toward the workpiece and the trigger of the tool is actuated to drive a nail through the pre-formed hole in the first workpiece and into a second workpiece whereby the first workpiece becomes attached to the second workpiece.

The fastener driving tool is of the type having a main body portion surmounting a guide body, a handle portion, a magazine, a magazine cover, a tool-actuating trigger and a trigger-enabling safety. The magazine contains a strip of nails and communicates with a drive track formed in the guide body. The main body portion of the tool contains a driver and a trigger actuated mechanism to drive and retract the driver. The drive track is adapted to receive the forwardmost nail of the strip thereof.

The magazine is supported at its forward end by a sleeve which is captively mounted on the guide body and is axially shiftable therealong. The magazine is shiftable along with the sleeve in directions parallel to the drive track axis between a lower position and an upper position. The magazine is provided with guide pins which travel in slots formed in the magazine cover to keep the magazine properly aligned during its travel between its upper and lower positions. The safety is affixed to the sleeve and travels with the sleeve and the magazine between a lower trigger disabling position and an upper trigger enabling position. The safety is biased to its lower position and the sleeve and magazine, associated with the safety, are biased by the safety to their lower positions. When the magazine is in its lower position, the forwardmost fastener in the drive track extends below the nose of the guide body serving as a probe to find the pre-formed hole in the first workpiece. When the magazine is in its upper position, the safety enables the trigger, the guide body nose rests upon the first workpiece with the drive track aligned with the pre-formed hole therein, and the forwardmost nail remains in the pre-formed hole. At this point, the tool is ready to be actuated by the trigger.

BRIEF DESCRIPTION OF THE DRAWINGS

FIG. 25 is an end elevational view of the nail guide of the present invention.

FIG. 26 is a side elevational view of the nail guide of FIG. 25.

FIG. 27 is an end elevational view of a guide post of the present invention.

DETAILED DESCRIPTION OF THE INVENTION

Figure 1:
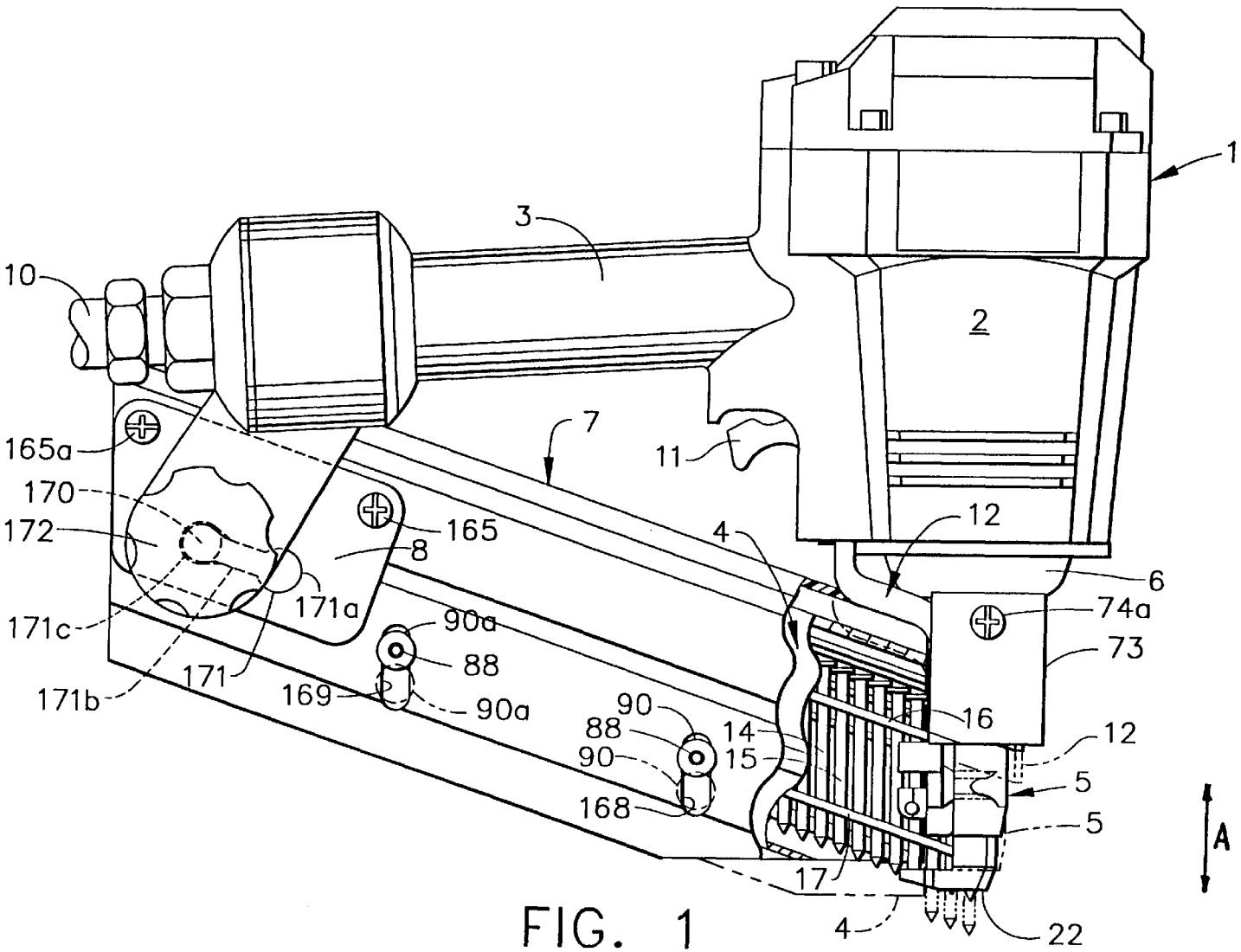
FIG. 1 is a right side elevational view of a fastener driving tool made in accordance with the teachings of the present invention.

Reference is first made to FIG. 1 wherein a nail driving tool, provided with the teachings of the present invention, is generally indicated at 1. The tool 1 comprises a main body portion 2 and a handle portion 3. The tool 1 is provided with the magazine of the present invention (generally indicated at 4), which is attached to a sleeve (generally indicated at 5), slidably mounted on the guide body (generally indicated at 6). The magazine 4 is shiftable vertically (as viewed in FIG. 1) in the directions of arrow A within a magazine cover (generally indicated at 7), which is attached at its forward end to guide body 6. The cover is also attached to the rearward end of handle 3 by means of a bracket 8 affixed to the cover and an extension 9 depending from the rearward portion of handle 3.

As indicated above, for purposes of an exemplary disclosure, the tool 1 constitutes a pneumatically actuated tool. To this end, the rearward end of handle portion 3 has a hose 10 removably attached thereto. The hose 10 is connected to a source of compressed air (not shown).

As is well known in the art, the main body portion 2 of the tool 1 houses a cylinder (not shown) containing a piston and driver assembly (not shown). The cylinder is connected to air under pressure by means of a main valve (not shown) to force the piston and driver downwardly to drive a nail through a pre-formed hole in a first workpiece and into a second workpiece. The main valve is actuated by a remote valve (not shown). The remote valve, in turn, is actuated by a manual trigger 11. The mechanism just described within the main body portion is well known in the art. The precise nature of the tool 1 is not a limitation of the present invention. As indicated in the preamble portion of the present specification, fastener driving tools can be actuated by other means including internal combustion means, solenoid means, flywheel means and the like. Finally, the tool 1 is provided with a modified trigger-enabling safety 12, to be described in detail hereinafter. As will be apparent hereinafter, the slide 5 and the attached magazine 4 and safety 12 are shiftable as a unit in the directions of arrow A, the directions of arrow A being substantially parallel to the axis of the guide body drive track 13.

It will be noted from FIG. 1 that the magazine holds a strip of nails 14. The strip of nails 14 is conventional and well known in the art. The nails 15 of the strip 14 are arranged in a tandem row with the head of each nail being overlapped by the head of the next nail therebehind. The nails are maintained in a strip by pairs of tape strips 16 and 17. Other means can be used to maintain the nails in a strip, as is well known in the art. Elongated plastic elements have been used heretofore, as have elongated wire elements individually welded to the shank of each nail. A nail strip feeder shoe (not shown in FIG. 1) is constantly urged by a spring (not shown in FIG. 1) toward the guide body 6, assuring that the forwardmost nail of the strip will be located within drive track 13.

Figure 3:
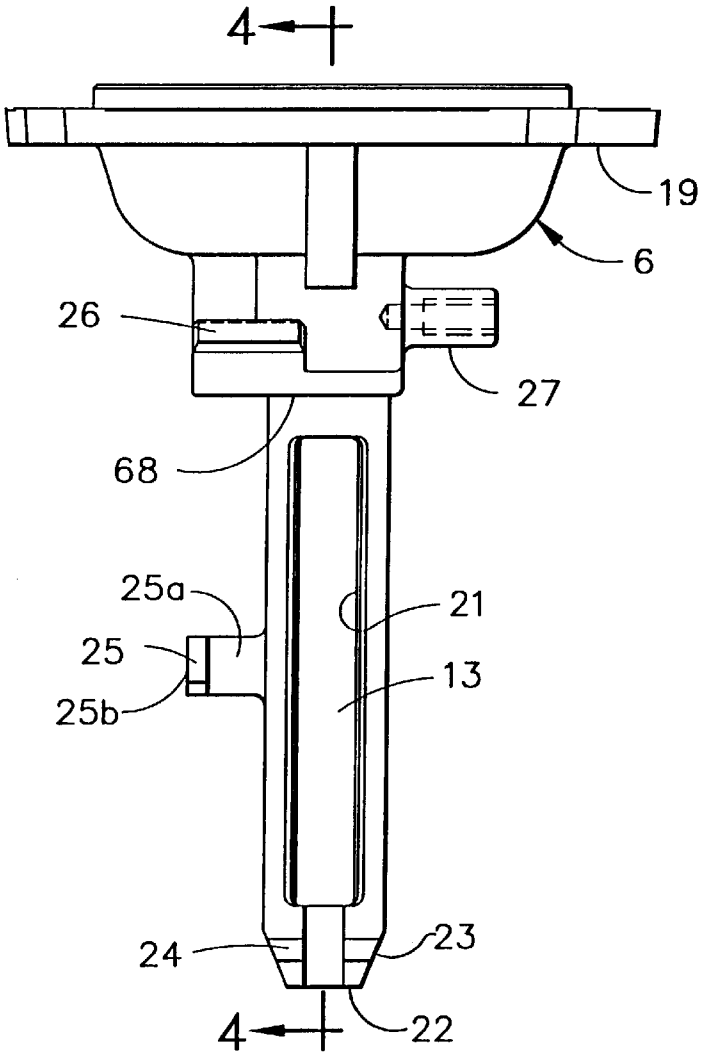
FIG. 3 is a rear elevational view of the guide body.
Figure 2:
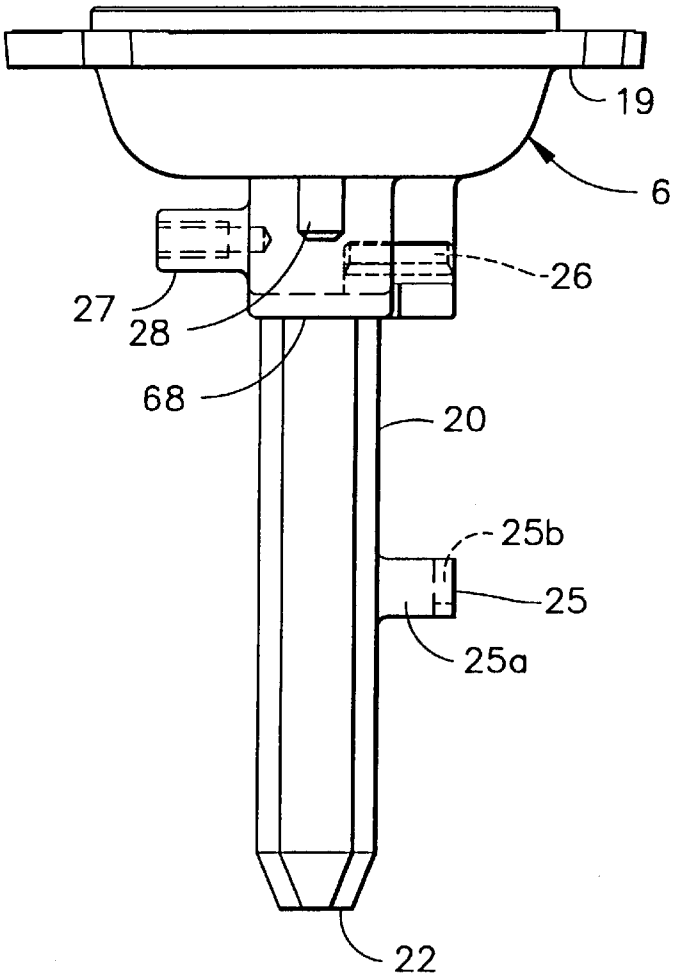
FIG. 2 is a front elevational view of the guide body.
Figure 4:
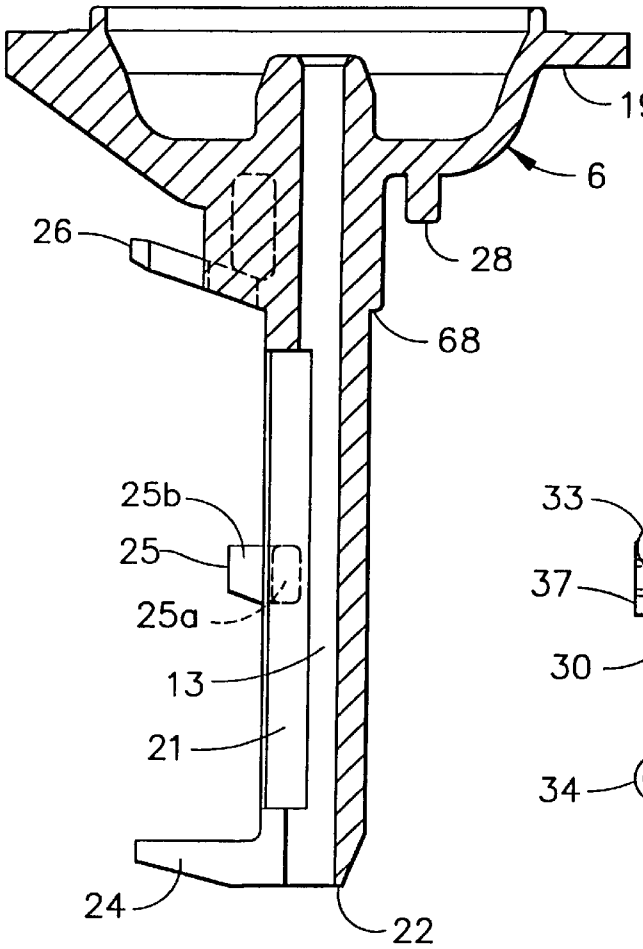
FIG. 4 is a cross-sectional view of the guide body taken along section line 4—4 of FIG. 3.
Figure 5:
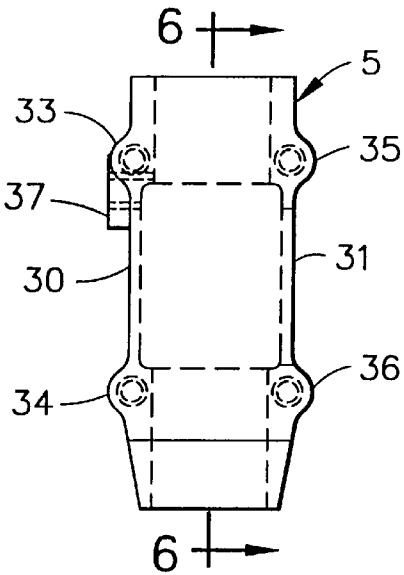
FIG. 5 is a front elevational view of the slide of the present invention.
Figure 6:
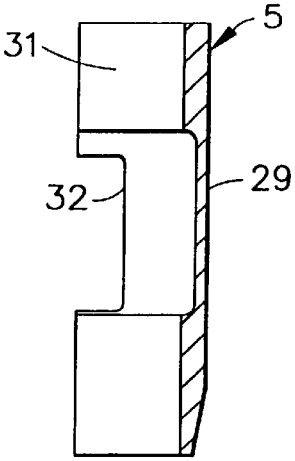
FIG. 6 is a cross-sectional view taken along section line 6—6 of FIG. 5.
Figure 7:
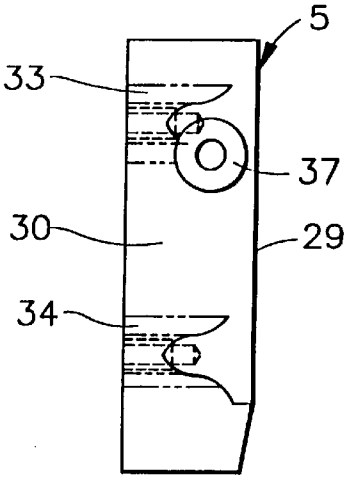
FIG. 7 is a right side elevational view of the slide.
Figure 8:
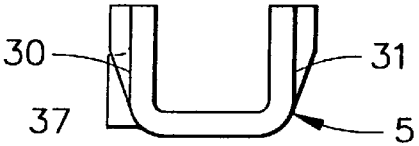
FIG. 8 is a top view of the slide.
Figure 12:
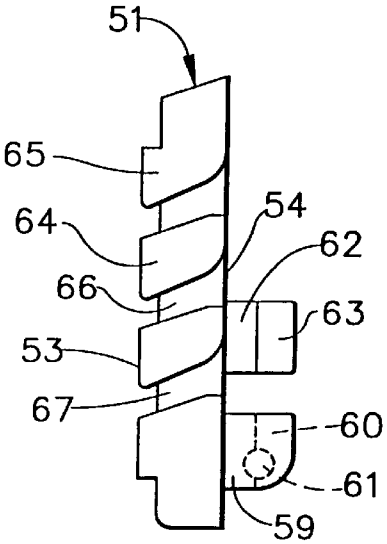
FIG. 12 is a left side elevational view of the right slide retainer of the present invention.

Reference is now made to FIGS. 2, 3 and 4 which illustrate the guide body 6 of the present invention. The guide body 6 comprises a base portion 19 which closes the bottom of the main body portion 2 of the tool 1 and is attached to the main body portion 2 by bolts or other appropriate means. Extending downwardly from guide body base portion 19 (as viewed in FIGS. 2–4), there is a second guide body portion 20 which contains drive track 13 (see FIG. 4). Access to the drive track from magazine 4 is afforded through elongated opening 21. Guide body portion 20 terminates in a lowermost nose portion 22. The nose portion includes a pair of rearward extensions 23 and 24. Extensions 23 and 24 serve two purposes. First of all, they act as guides for the lowermost portions of the nails as they pass from the magazine into the guide body and drive track. Secondly, they determine the lowermost position of the sleeve which is slidably mounted on the guide body 6, as will be described hereinafter.

Referring to FIG. 3, the guide body 6 has an integral L-shaped lug or nail stop 25. The nail stop comprises a laterally extending portion 25*a* terminating in a rearwardly extending portion 25*b*. The nail stop prevents the last few nails of a strip from being driven by the tool until a new strip has been introduced into the magazine. This is to prevent an instance where the tool is actuated and there is no nail in the drive track to be driven by the driver. The nail stop is located on the left side of the guide body 6. Throughout this specification and in the claims when reference is made to the left or right side of the tool or any part thereof, this is based upon the operator's perception of the left and right sides, when holding the tool for actuation thereof.

As is best seen in FIGS. 3 and 4, the guide body 6 is provided with a rearwardly and upwardly extending lug 26 which engages in a slot in magazine cover 7, as will be more fully described hereinafter. In this way, the guide body 6 supports the forward end of magazine cover 7. On its right side, guide body 6 is provided with a boss 27 containing a threaded bore. Boss 27 is intended to support the safety spring cover to be described hereinafter, the safety spring cover being bolted thereto. Finally, the guide body 6 is provided with a downwardly depending mount 28 for the safety spring to be described hereinafter. The mount 28 is best seen in FIGS. 2 and 4.

Reference is now made to FIGS. 5 through 8 wherein the slide of the present invention is illustrated. As viewed from the top, the slide 5 is of a generally U-shaped configuration, having a front wall 29, a right wall 30 and a left wall 31. As is clearly shown in FIG. 6, left wall 31 has a notch 32 formed therein to accommodate nail stop 25 of guide body 6.

The right side 30 of slide 5 is provided with a pair of bosses 33 and 34. In a similar fashion, the left side 31 of slide 5 is provided with a pair of bosses 35 and 36. The bosses 33, 34, 35 and 36 are provided with threaded bores 33*a*, 34*a*, 35*a* and 36*a*, respectively, opening to the rear of the slide. The purposes of bosses 33–36 and threaded bores 33*a*–36*a* will be apparent hereinafter.

The slide 5 is completed by the provision on its right side of an additional boss 37. The boss 37 has a threaded bore. As will be described hereinafter, the safety of the present invention is affixed to the slide by means of a machine screw threadedly engaged in boss 37.

Figure 10:
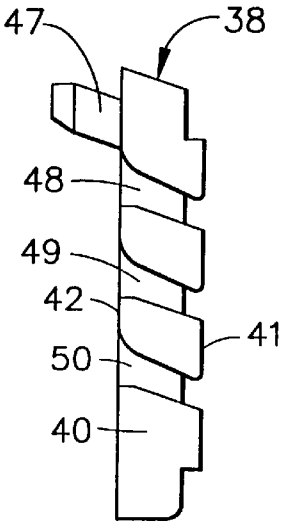
FIG. 10 is a right side elevational view of the left slide retainer of the present invention.
Figure 9:
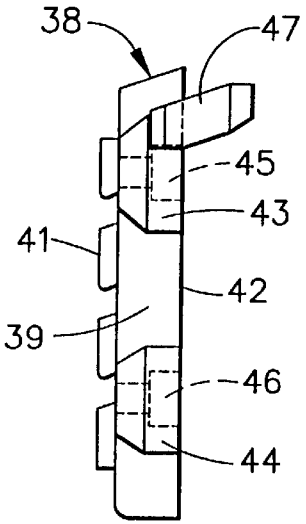
FIG. 9 is a left side elevational view of the left slide retainer of the present invention.

A left slide retainer is illustrated in FIGS. 9 and 10. The left slide retainer, generally indicated at 38, has an exterior surface 39, an interior surface 40, a forward edge 41 and a rearward edge 42. On its exterior surface 39 the left slide retainer is provided with a pair of bosses 43 and 44 having countersunk bores 45 and 46 formed therein, respectively. The exterior surface 39, near its upper end (as viewed in FIGS. 9 and 10) has an upwardly and rearwardly extending lug 47 adapted to be received in a slot at the forward end of magazine 4 to attach the magazine 4 to the left side retainer. The left side retainer has three slots 48, 49 and 50. The slots constitute support means for the heads of three different size nails. In an exemplary embodiment, the tool 1 was capable of using strips of 2.5 inch nails, 2 inch nails and 1.5 inch nails. To this end, the slot 48 would accommodate the heads of 2.5 inch nails, the slot 49 would accommodate the heads of 2 inch nails and the slot 50 would accommodate the heads of 1.5 inch nails.

Figure 11:
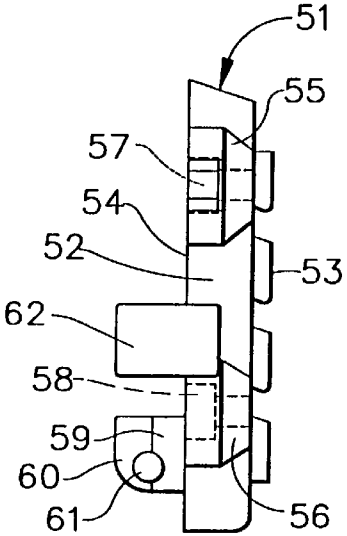
FIG. 11 is a right side elevational view of the right slide retainer of the present invention.
Figure 13:
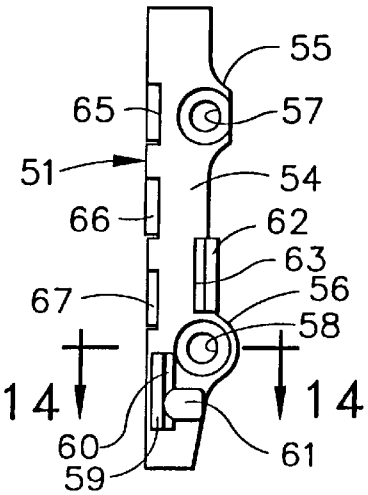
FIG. 13 is a rear elevational view of the right slide retainer of the present invention.
Figure 14:
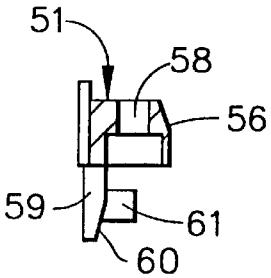
FIG. 14 is a cross-sectional view taken along section line 14—14 of FIG. 13.

FIGS. 11 through 14 illustrate the right slide retainer of the present invention, generally indicated at 51. It will be noted that, with a few exceptions, the right slide retainer 51 is a mirror image of the left slide retainer 38. As is best seen in FIGS. 11 and 13, the right slide retainer 51 has an exterior surface 52, a forward edge 53 and a rearward surface 54.

The exterior surface 52 has formed thereon a pair of bosses 55 and 56 containing countersunk bores 57 and 58, respectively.

The rear surface 54 of the right side retainer 51 has extending therefrom a lug 59. The lug 59 has an inside surface which is partially tapered as at 60 and from which a cylindrical lug 61 extends transversely of retainer 51. In a similar fashion, a second lug 62 extends rearwardly from the outside surface 52 and the rear surface 54 of retainer 51. The lug 62 has a tapered inner surface portion 63. As will be set forth hereinafter, the lugs 59, 61 and 62 engage the forward end of magazine 4 in such a way as to preclude side-to-side movement of the magazine with respect to slide 5.

Finally, the right slide retainer has an inside surface 64 (see FIG. 12) provided with three spaced grooves 65, 66 and 67, equivalent to the left slide retainer grooves 48, 49 and 50, respectively, and serving the same purpose.

Figure 15:
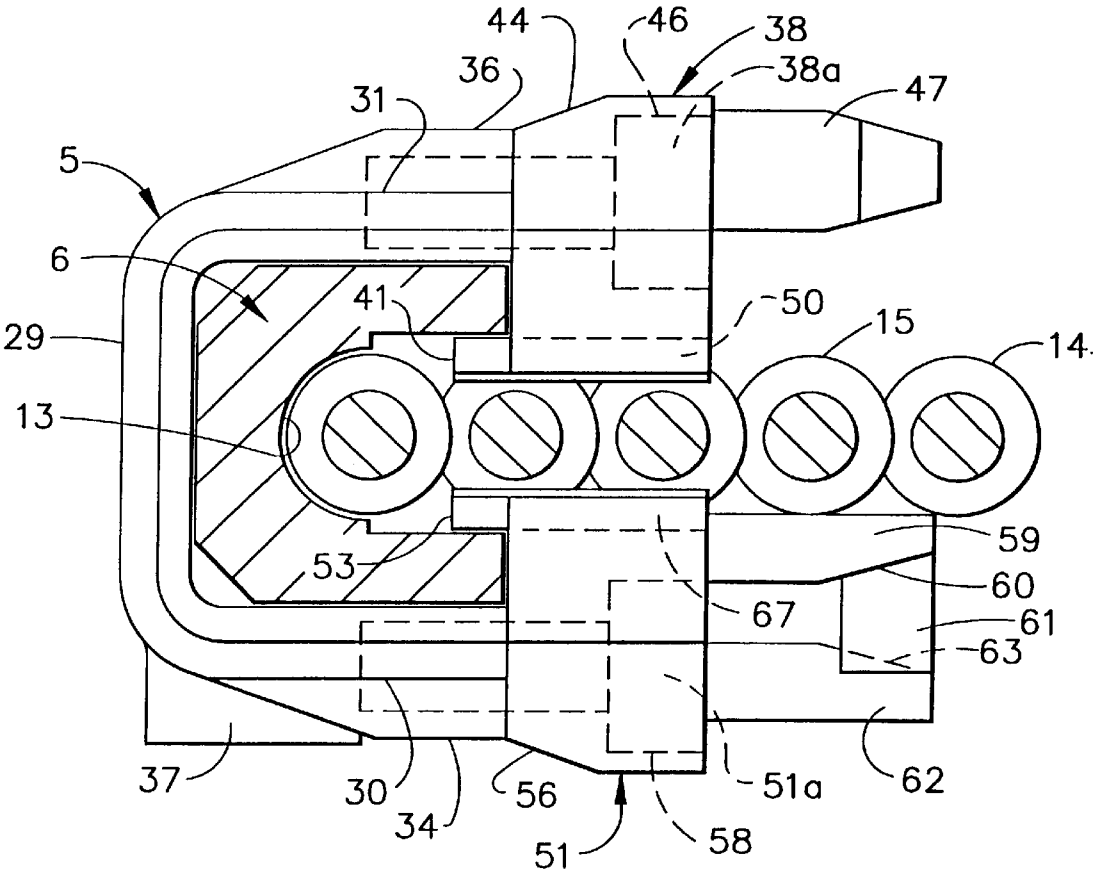
FIG. 15 is a bottom view, partly in cross-section, of the slide and slide retainers mounted on the guide body.

FIG. 15 is a bottom view, partly in cross-section, of the slide assembly captively and slidably mounted on the guide body 6. As is clearly shown, the right slide retainer is affixed to the right side of slide 5. This is accomplished by machine screws 51*a* passing through countersunk bores 57 and 58 of right side retainer 51 and into the threaded bores of slide bosses 33 and 34, respectively. In a similar fashion, the left slide retainer 38 is attached to slide 5 by a pair of machine screws 38*a* passing through countersunk bores 45 and 46 of retainer 38 and into the threaded bores of slide bosses 35 and 36, respectively. It will be noted that the forwardmost edges 41 and 53 of slide retainers 38 and 51 extend into the opening 21 of guide body 6 rendering the slide assembly captive on guide body 6. As indicated above, the lowermost position of the slide assembly on guide body 6 is determined by the guide body rearward extensions 23 and 24. The upper position of the slide assembly is determined by the shoulder 68 of guide body 6 (see FIGS. 2, 3 and 4).

For purposes of an exemplary showing, FIG. 15 illustrates a portion of a strip 15 of nails 14. The forwardmost nail is shown in position in drive track 13 of guide body 6. The second and third nail of the strip are supported by one of the pairs of slide retainer slots 48–65, 49–66 or 50–67. For purposes of an exemplary showing, the pair of slots 50–67 are designated in FIG. 15 and the nails having a length of about 2 inches. The remainder of the nails of the strip 14 will be supported within the magazine 4, as will be described hereinafter.

Figure 17:
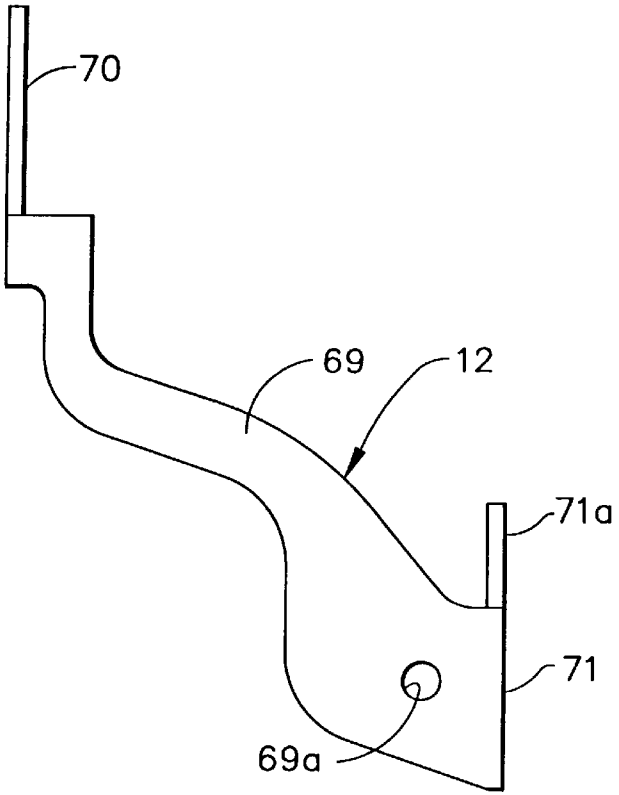
FIG. 17 is a right side elevational view of the safety of FIG. 16.
Figure 16:
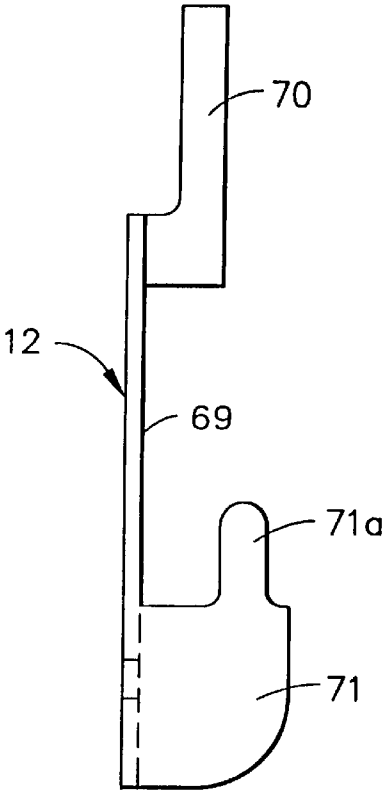
FIG. 16 is a front elevational view of the safety of the present invention.

Reference is now made to FIGS. 16 and 17, wherein the modified safety of the present invention is illustrated. The safety, generally indicated at 12 in FIGS. 1, 16 and 17, comprises a formed sheet metal member having a main body portion 69. The body portion 69 terminates at its upper end (as viewed in FIGS. 16 and 17) in an inturned portion which is capable of contacting the trigger mechanism and enabling trigger 11 to actuate the tool 1 when safety 12 is in its upper position. At its lower end, as viewed in FIGS. 6 and 7, the safety has an inturned portion 71 with an upstanding member 71*a* which constitutes a spring seat or retainer. The main body portion 69 of safety 12 is provided near its lower end (as viewed in FIGS. 16 and 17) with a hole 69*a*. The safety 12 is attached to the boss 37 of slide 5 by a machine screw passing through the safety hole 69*a* and into the threaded hole of the slide boss 37.

Figure 28:
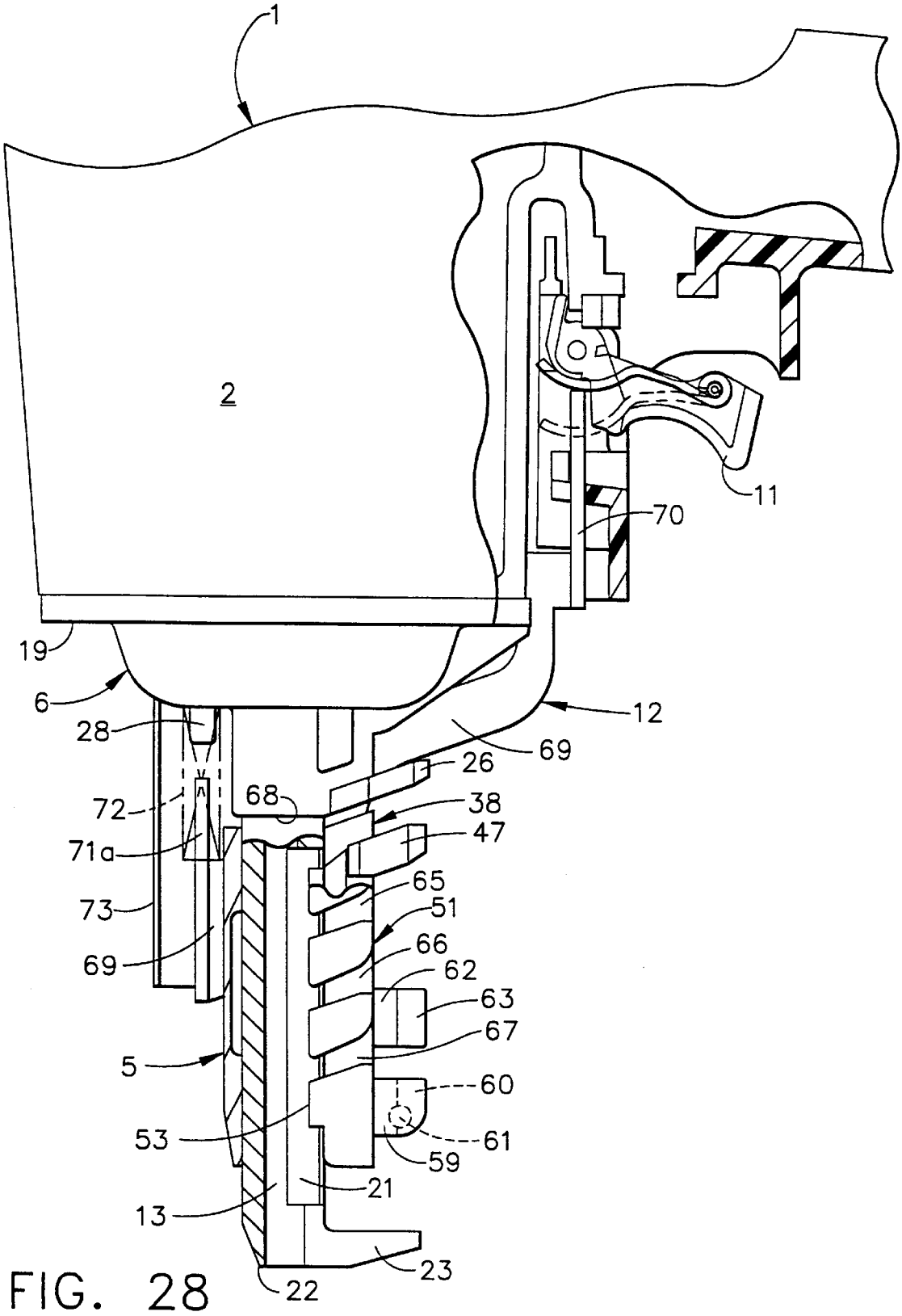
FIG. 28 is a fragmentary side elevational view, partly in cross-section, illustrating the assembly of the guide body, the slide and slide retainers, the safety, the safety spring and the safety spring guard.

As is shown in FIG. 28, when the safety is attached to the slide 5, it is provided with a compression spring 72. The upper end of compression spring 72 is engaged on spring mount 28 of guide body 6 (see FIGS. 2 and 4) and also on spring mount 71*a* of safety 12. The compression spring 72 constantly urges the safety 12 to its lower position. Since the safety 12 is attached to slide 5 and since the forward end of the magazine 4 is attached to the slide retainers 38 and 51, it will be understood that the slide assembly, the magazine and the safety constitute an integral assembly. Thus, spring 72 not only urges the safety 12 to its lower position, but also the slide assembly and the magazine to their lower positions.

Figure 18:
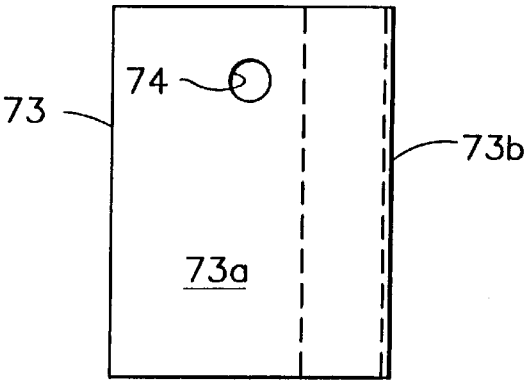
FIG. 18 is a right side elevational view of the safety spring cover of the present invention.
Figure 19:
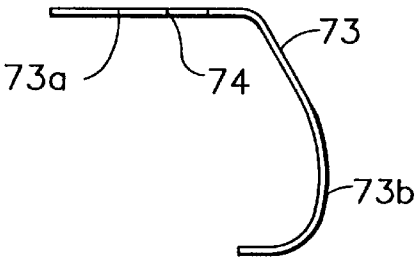
FIG. 19 is a bottom view of the safety spring cover of FIG. 18.

A guard may be provided for safety spring 72. An exemplary guard is illustrated in FIGS. 1, 18 and 19. The guard 73 has a planar side portion 73*a* and a curved portion 73*b* which extends about forward part of safety 12 and the safety spring 72. The planar side 73*a* of the safety spring guard 73 has a hole 74 formed therein. The guard is attached to guide body 6 by a machine screw 74*a* passing through guard bore 74 and into the threaded bore of the guide body boss 27 (see FIGS. 2 and 3). FIG. 28 shows a partial view of the spring guard 73 mounted in place on the guide body 6.

Figure 20:
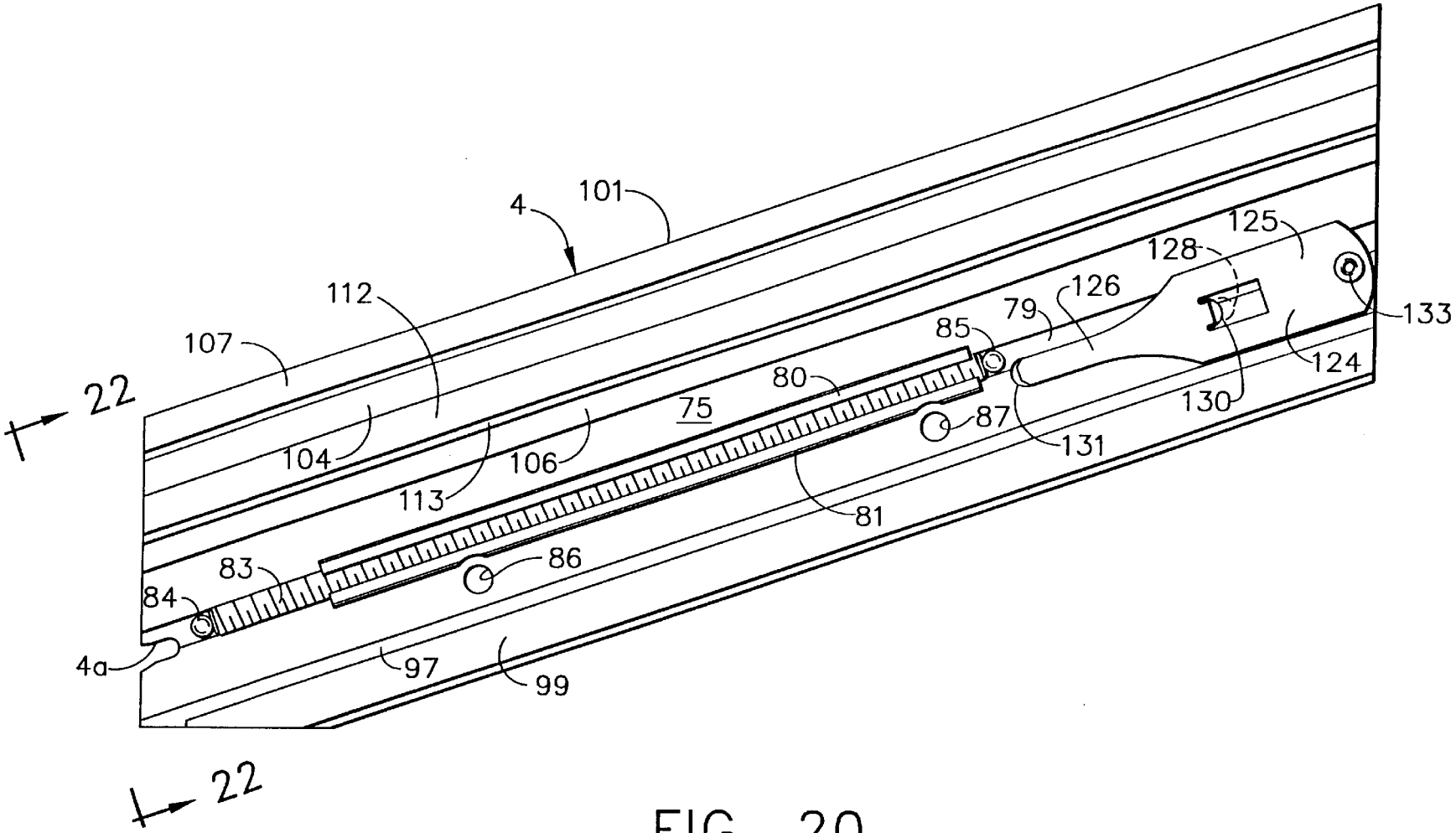
FIG. 20 is a left side elevational view of the magazine of the present invention.
Figure 22:
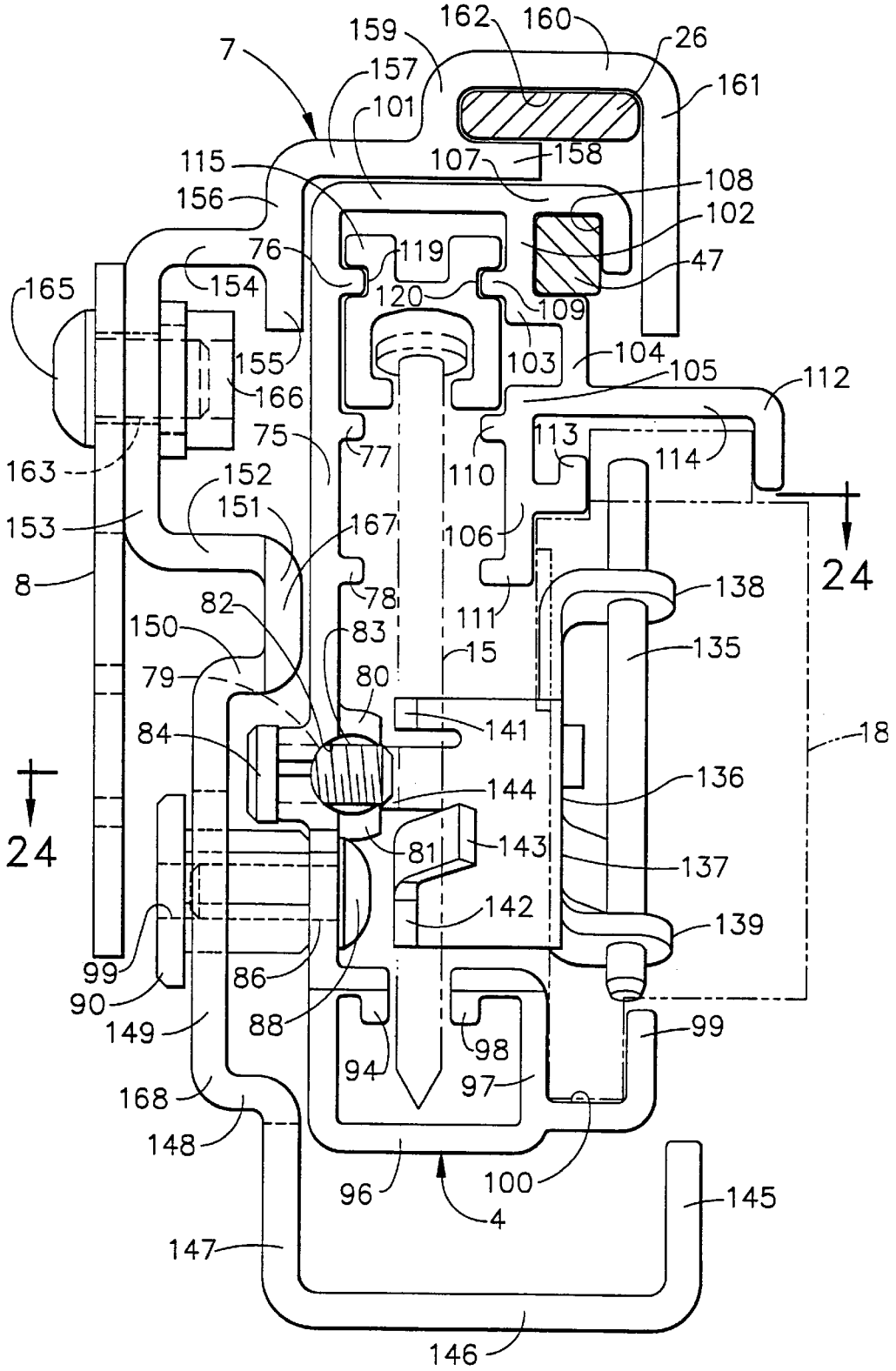
FIG. 22 is an axial end view of the magazine and magazine cover assembly as viewed along the line c—c of FIG. 21.

Reference is now made to FIGS. 20 and 22. FIG. 20 is a left side elevational view of the magazine 4 of the present invention. FIG. 22 is an end view of magazine 4 as seen from line 22—22 of FIG. 20.

The magazine 4 is an elongated hollow member, preferably made of metal. Magazine 4 has a right side 75, the upper portion of which has three parallel, evenly spaced, interior flanges 76, 77 and 78, extending the length of magazine 4. The purpose of flanges 76–78 will be apparent hereinafter.

The inside surface of the right magazine side 75 has a shallow arcuate groove 79 formed therein and extending the length of the magazine. The groove 79 is flanked by a pair of flanges 80 and 81, curved in cross-section, and extending part of the length of magazine 4 (see FIG. 20). As is particularly apparent in FIG. 22, the shallow groove 79 and its flanges 80 and 81 define an overall groove 82 of circular cross-section. The groove 82 is adapted to receive a rod 83 of circular cross-section and provided with fine exterior threads. The rod 83 may be inserted longitudinally in groove 82 and is precluded from axial movement by a pair of machine screws 84 and 85 which pass through threaded perforations in the right magazine wall 75 and are located adjacent the ends of threaded rod 83. As will be explained in greater detail hereinafter, the threaded rod 83 serves as an elongated ratchet member which cooperates with the feeder clip of the feeder shoe.

As is most clearly shown in FIG. 20, magazine 4 is provided with a pair of perforations 86 and 87 located just beneath flange 81. The perforation 86 is shown in FIG. 22. The perforation received a machine screw 88. The machine screw 88 is threadedly engaged in the threaded axial bore 89 of a guide post 90. The guide post 90 is also illustrated in FIG. 27. It is apparent from FIG. 27 that the shank of guide post 90 is provided with a pair of diametrically opposed flats 91 and 92. The perforation 87 also receives a machine screw 88*a* similar to machine screw 88. The machine screw of perforation 87 mounts a second identical guide post 90*a* to the exterior of magazine 4 (see FIG. 1). The purpose of the guide posts will be clear hereinafter.

Beneath the bores 86 and 87, the magazine wall 75 has on its interior surface an inwardly and downwardly extending L-shaped lug 94 the purpose of which will be set forth hereinafter. The wall 75 terminates in a bottom wall 96. Bottom wall 96 leads to a left wall portion 97 which terminates in an inwardly and downwardly extending L-shaped lug 98 parallel to and spaced from lug 94 of wall 75. The L-shaped lugs 94 and 98 extend the length of magazine 4. The left wall portion 97 also has an exterior outwardly and upwardly extending portion 99 which extends the length of magazine 4 and forms a channel shaped slot 100 for the bottom portion of feeder shoe 18, to be described hereinafter.

At its upper end, as viewed in FIG. 22, the right wall 75 terminates in a top 101, which extends the length of magazine 4. An upper portion of the left wall depends downwardly (as viewed in FIG. 22) from top 101 and extends the length of magazine 4. The upper portion of the left wall comprises (again as viewed in FIG. 22) a downwardly depending portion 102, an outwardly extending portion 103, a downwardly depending portion 104, an inwardly extending portion 105 and a downwardly depending portion 106. At the juncture of the top 101 and the left side portion 102 there is an L-shaped extension 107. It will be noted that the extension 107, the left wall portion 102 and the left wall portion 103 define a rectangular socket 108. The socket 108 receives the lug 47 of the left slide retainer 38, whereby the magazine 4 is removably attached to the slide assembly. The portions 102 and 106 of the left magazine side portion carry inwardly directed, equally spaced, parallel flanges 109, 110 and 111, which run the length of magazine 4. It will be noted that the flanges 109–111 correspond to the magazine right wall flanges 76–78. The purpose of these flanges will be set forth hereinafter.

At the juncture of magazine left wall portions 104 and 105 there is an outwardly directed L-shaped flange 112. Extending from magazine left wall portion 106 there is another outwardly directed L-shaped flange 113. Flanges 112 and 113 define an upper channel 114 receiving an upper portion of feeder shoe 18. Thus, feeder shoe is capable of traveling along magazine 4 in channels 100 and 114.

Reference is now made to FIGS. 25 and 26. These Figures illustrate the nail head guide. As is most clearly shown in FIG. 26, the nail head guide constitutes an elongated member, preferably made of plastic or metallic material. The nail head guide 115 has a length substantially equal to the length of magazine 4.

As is most clearly shown in FIG. 25, the nail head guide 115 is transversely H-shaped, having legs 116 and 117 and transverse web 118. The legs 116 and 117 are provided with notches 119 and 120, respectively and in-turned flanges 121 and 122. The in-turned flanges 121 and 122, the legs 116 and 117, and the web 118 form a socket 123 for receipt of the heads of the nails of a nail strip, the shanks of the nails passing between flanges 121 and 122.

As shown in FIG. 22, the nail head guide 115 is mounted in the magazine 4 with the magazine flanges 76 and 109 engaging the slots 119 and 120 of the nail head guide. A nail 115 is shown in place. It will be noted that the lowermost end of nail 115 extends between and is guided by the magazine flanges 94 and 98.

It will be apparent from FIG. 22 that the nail head guide 115 could be mounted so that the magazine flanges 77 and 110 enter the nail guide grooves 119 and 120. Similarly, the nail head guide 115 could be mounted within magazine 4 such that the magazine flanges 78 and 111 enter the nail head guide grooves 119 and 120.

As indicated above, the magazine 4 may be designed to accommodate three sizes of nails, as for example a 2.5 inch nail, a 2 inch nail, and a 1.5 inch nail. In FIG. 22, the nail head guide is in its uppermost position (as viewed in that Figure) and the nail 115 may be considered to be a 2.5 inch nail. If the nail head guide 115 is mounted in its intermediate position, it would accommodate a strip of 2 inch nails. If mounted in its lowermost position, the nail head guide would accommodate a strip of 1.5 inch nails.

Figure 24:
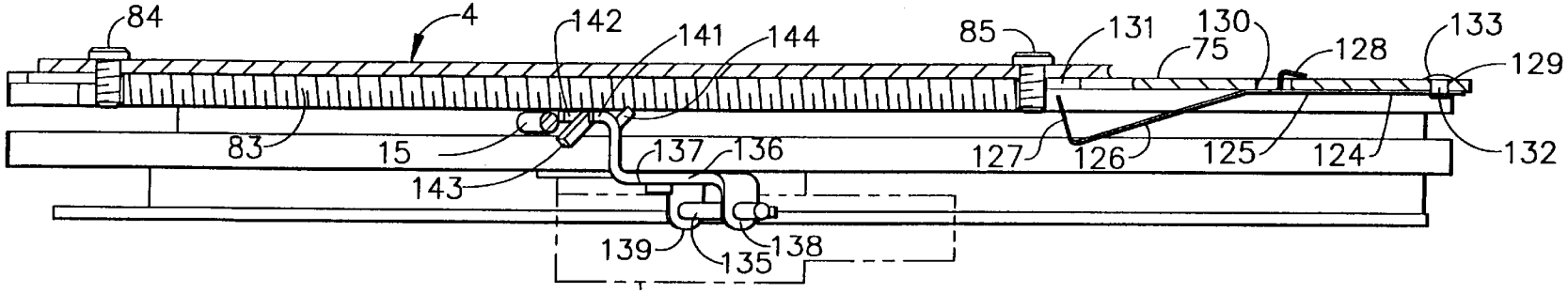
FIG. 24 is a cross-sectional view taken along section line 24—24 of FIG. 23.

Reference is now made to FIGS. 20 and 24. It will be understood that the magazine may be loaded with a strip of nails in any appropriate manner. For purposes of an exemplary showing, the magazine 4 is loaded from its rearward end. A spring clip 124 is provided to prevent a strip of nails from inadvertently sliding out of the rearward opening of magazine 4 before it is engaged by feeder shoe 18. The spring clip 124 comprises a body portion 125 and a spring tine 126 having an out-turned end 127. In FIG. 24, the tine 126 is shown in its normal position, angularly related to the body portion 125 so as to locate end portion 127 across the path of travel of the strip of nails. The main body portion 125 of spring clip 124 has a cut out portion from which a tab 128 is formed. The magazine 4 has three openings formed in its right wall 75. The openings are shown at 129, 130 and 131. To mount spring clip 124 in position, the tab 128 is inserted through opening 130 and the entire spring clip 124 is shifted rearwardly. This causes tab 128 to engage the right wall 75 of magazine 4. This also causes an opening 132 in spring clip 124 to align with the opening 129 of the magazine right wall 75 so that the spring clip 124 may be further attached to the right wall 75 by a rivet 133.

When a strip of nails is inserted through an opening in the rearward end of magazine 4, the tine 126 and its forwardmost portion 127 will bend out of the way, shifting toward magazine wall 75, with the tine portion 127 passing through opening 131. Once the strip of nails has passed tine 126 and its forward portion 127, they will return to their normal positions as shown in FIG. 24, the portion 127 precluding the strip of nails from inadvertently sliding out of the magazine through its rearward opening. If it is desired to remove the strip of nails from the magazine, the tine may be manually depressed against wall 175 until the strip of nails engage the tine. Tine 126/127 will remain until depressed until the strip of nails is moved toward the rear of the magazine and out of contact with the tine 126/127.

Figure 23:
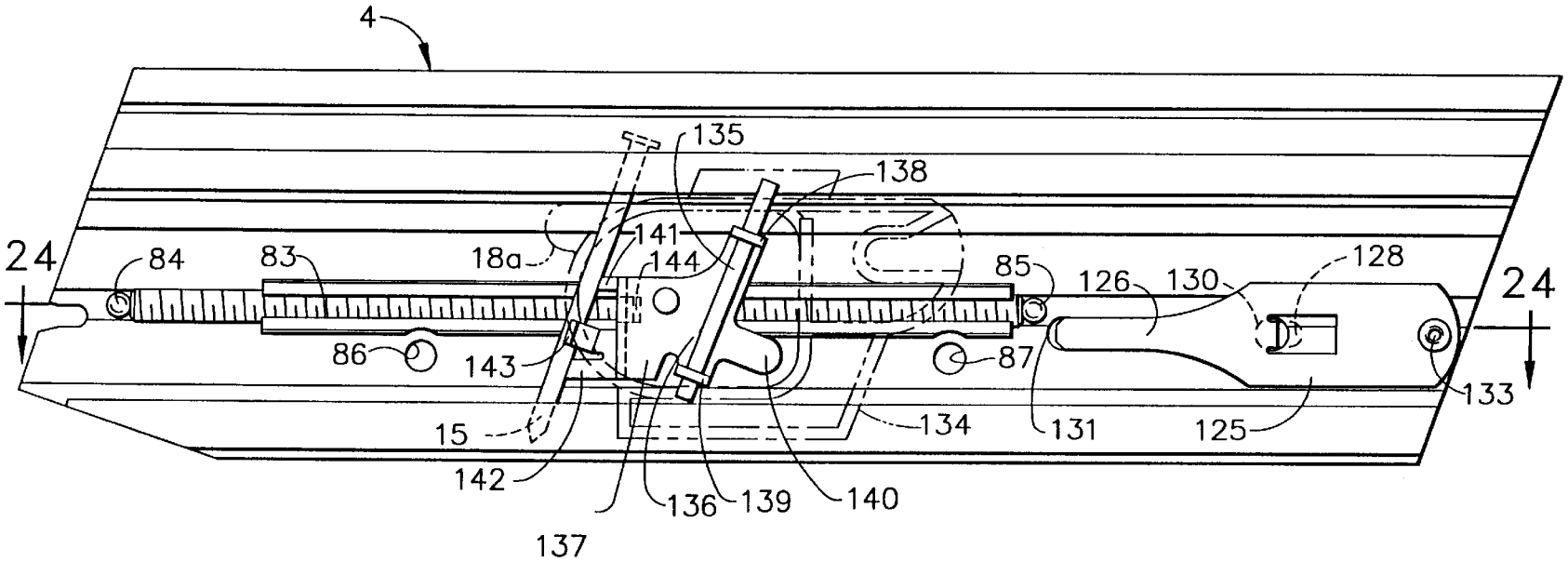
FIG. 23 is a fragmentary left side elevational view of the structure of FIG. 22.

Reference is now made to FIGS. 22, 23 and 24 wherein the feeder shoe 18 is shown in phantom lines. As indicated above, the feeder shoe rides in lower channel 100 and upper channel 114 of the magazine 4. The feeder shoe comprises a plastic housing 134 having a forwardly extending nose 18*a* (see FIG. 23), the purpose of which will be set forth hereinafter. The feeder shoe housing is constantly urged forwardly by a negator spring (not shown), as is well known in the art. The feeder shoe housing 134 supports a pivot pin 135. Rotatively mounted on pin 135 there is a feeder clip 136. The feeder clip 136 has a main body portion 137 provided with a pair of upstanding lugs 138 and 139 having coaxial holes formed therein through which pivot pin 135 extends. The main body portion 137 has a handle 140 at its rearward end. At its forward end, the main body portion has a pair of nail-engaging lugs 141 and 142 (see also FIGS. 22 and 24). The forward part of main body portion 137 has an outwardly bent lug 143 which partially overlies nail 115, as shown in these Figures. It will be understood that nail 115, shown in FIGS. 22–24, constitutes the rearwardmost nail of a nail strip. It will also be noted that the lugs 141, 142 and 143 are configures to accommodate the fact that the magazine slopes downwardly and forwardly with respect to the tool since the heads of the nails of a strip are slightly overlapped. Finally, the feeder clip has a fourth lug which is bent rearwardly, as viewed in the Figures, and is engageable with the threaded rod or ratchet 83. A small compression spring, (not shown) biases the feeder clip 136 to the position shown in FIGS. 22–24 wherein the lugs 141, 142 and 143 engage the rearwardmost nail 115 of a strip and the rearwardly directed lug 144 engages ratchet 83.

Since the feeder shoe 18 is constantly urged forwardly toward guide body 5, the lugs 141, 142 and 143 will constantly urge the forwardmost nail of the strip into drive track 13. When a strip of nails is introduced into the magazine 4, and the feeder shoe is in a forward position, handle portion 140 of feeder clip 136 may be depressed inwardly of the magazine 4. As will be apparent from FIG. 24, this will pivot the feeder clip about pivot pin 135 and will lift feeder clip lugs 141, 142, 143 and 144 over the strip of nails so that the feeder shoe may be pulled rearwardly to a position behind the strip of nails. At this point, the handle 140 of the feeder clip 136 may be released and feeder clip lugs 141, 142 and 143 will engage the rearwardmost nail 115 of the strip, and the feeder clip lug 144 will engage the rachet 183. The purpose of rearwardly directed feeder clip lug 144 will be set forth hereinafter.

The magazine 4 is completed by the provision of a notch 4*a* in its forward end. Notch 4*a* accommodates cylindrical lug, 61 of right slide retainer 51, as will be explained further hereinafter.

Figure 21:
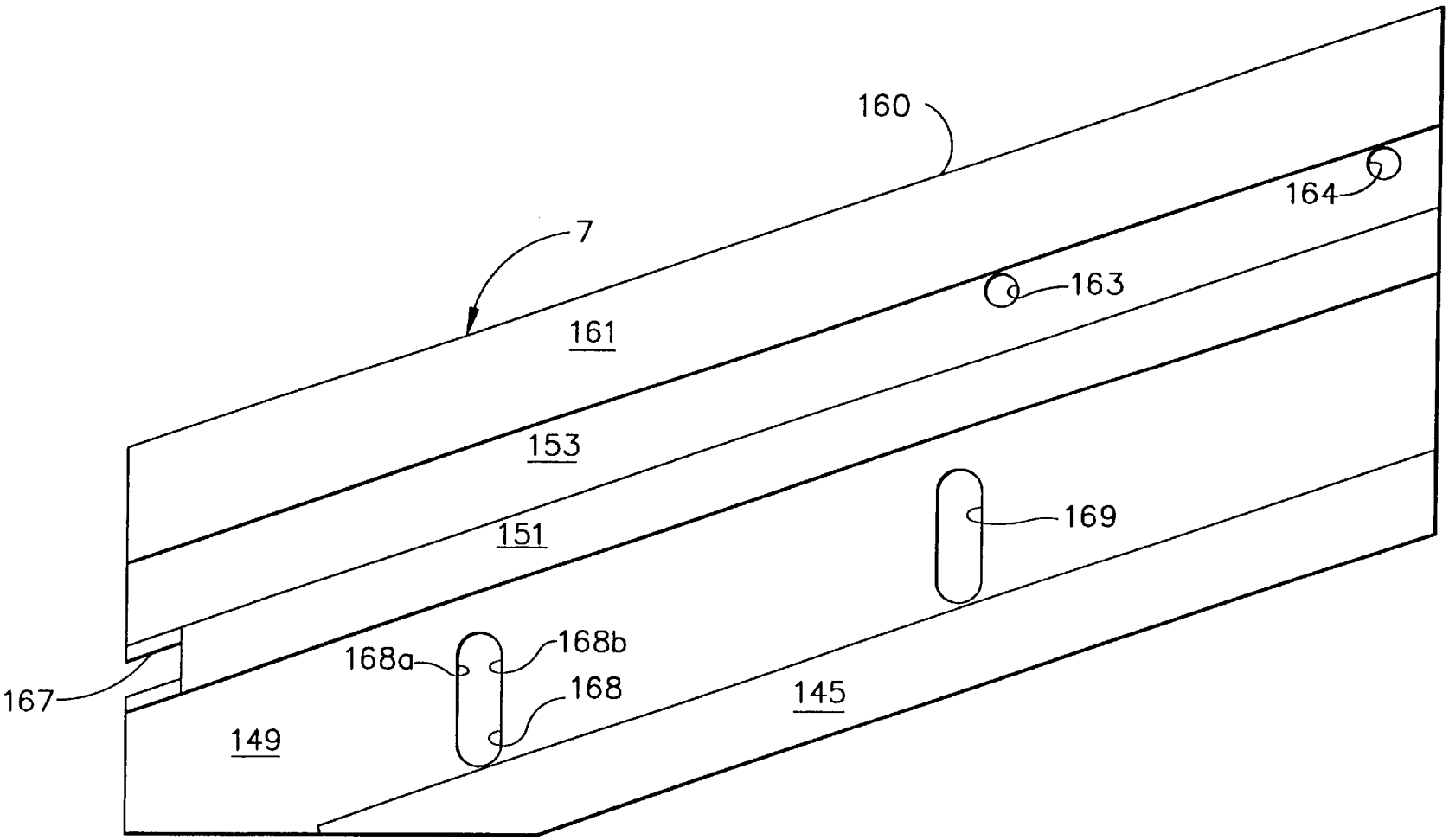
FIG. 21 is a left side elevational view of the magazine cover of the present invention.

Reference is now made to FIGS. 21 and 22 wherein the magazine cover 7 is shown. FIG. 21 is a left side elevational view of the magazine cover 7. The magazine cover 7 is adapted to receive magazine 4 and to permit linear shifting of magazine 4 therein in directions parallel to the axis of the drive track.

Turning to FIG. 22, magazine cover has a lower left wall portion 145 which leads to a bottom portion 146. The bottom portion 146, in turn, leads to a first right wall portion 147. Portion 147 leads to an outwardly directed portion 148, an upwardly directed portion 149 (as viewed in FIG. 22) and an in-turned portion 150. From the in-turned portion 150, the right wall has an upwardly directed portion 151, an outwardly directed portion 152, an upwardly directed portion 153 and an in-turned portion 154. In-turned portion 154 leads to a downwardly depending portion 155 and an upwardly depending portion 156 (as viewed in FIG. 22). Portion 156 terminates in an inwardly directed portion 157 which branches into an additional inwardly directed portion 158 and an upwardly directed portion 159. Portion 159 terminates in a transverse portion 160, which ends in a downwardly depending portion 161.

It will be noted in FIG. 22 that the magazine cover portions 158, 159, 160 and 161 form a socket 162 for receipt of the lug 26 (see FIGS. 2, 3 and 4) of guide body 6. In this way, cover 7 is attached to the guide body.

The portion 153 of the magazine cover 7 has a pair of perforations 163 and 164 formed therein. The perforations 163 and 164 are adapted to receive a pair of bolts which pass through perforations in the mounting bracket 8 (see also FIG. 1) and through the perforations 163 and 164, and which are provided with nuts. One such bolt is shown at 165, passing through the mounting bracket 8, the magazine perforation 163 and provided with a nut 166. It will be understood that the second bolt 165*a* (see FIG. 1) passes through a perforation in the mounting bracket and perforation 164, and is provided with a nut (not shown).

The portion 151 of cover 7 is, at its forwardmost end, cut away to create a notch 167. The notch 167 provides clearance in the magazine cover 7 for the lug 62 (see FIGS. 11–13) of the right slide retainer 51.

The magazine cover 7 has formed in portion 149 and 148 thereof a pair of elongated, obround slots 168 and 169. As is clearly shown in FIG. 22, the slot 168 is adapted to receive the shank of guide post 90. The sidewalls 168*a* and 168*b* of slot 168 are parallel to the axis of the drive track 13 of tool 1 and cooperate with the flats 91 and 92, respectively on the shank of guide post 90. It will be understood that the second guide post 90*a*, attached to magazine 4, has a shank with flats which passes through the magazine cover slot 169 (see FIG. 1). The guide posts and slots through they pass cooperate to guide the shifting of magazine 4 in directions parallel to the axis of the drive track 13, as indicated above and as will be further described hereinafter.

FIG. 28 illustrates the assembly of the guide body 6, the slide 5, the slide retainers 38 and 51, the safety 12, the safety spring 72 and the safety spring guard 73. In FIG. 28, the lower portion of the guide body 6 is in cross-section to show the drive track 13. The slide 5 is also shown in cross-section. The left slide retainer 38 is fragmentarily shown including its lug 47 by which the magazine 4 (not shown in FIG. 28) is attached to the slide assembly. The right slide retainer 51 is shown with its rearwardly extending lugs 62 and 59 to be described hereinafter with respect to FIG. 29.

It will be remembered that the safety 12 is attached to slide 5 by a machine screw threadedly engaged in the boss 37 (not shown in FIG. 28) of slide 5. The main body portion 69 of safety 12 has at its upper end the upstanding lug 70 which cooperates with the trigger to enable the trigger when the safety 12 is in its uppermost position. The main body portion 69 of safety 12 also has an upstanding spring seat 71*a* which cooperates with spring seat 28 of guide body 6 to mount compression spring 72. Spring 72 is provided with the spring guard 73, shown both in FIGS. 1 and 28. It will be remembered that the spring guard 73 is attached by machine screw 74*a* to the threaded boss 27 of the guide body (see FIGS. 2 and 3). Finally, it will be noted that the forward edge 53 of the right slide retainer 51 overlaps the opening 21 of the guide body. The same is true of the forward edge 41 of the left slide retainer 38. In this manner, the left and right retainers 38 and 51 maintain the slide 5 captive on guide body 6. The slide assembly (the slide 5 and the slide retainers 38 and 51) is shiftable on the guide body in directions parallel to the axis of drive track 13. The uppermost position of the slide assembly is determined by abutment with the shoulder 68. The lowermost position of the slide assembly is determined by abutment with the rearward extension 23 and its counterpart 24 (not shown in FIG. 28, see FIG. 4).

Figure 29:
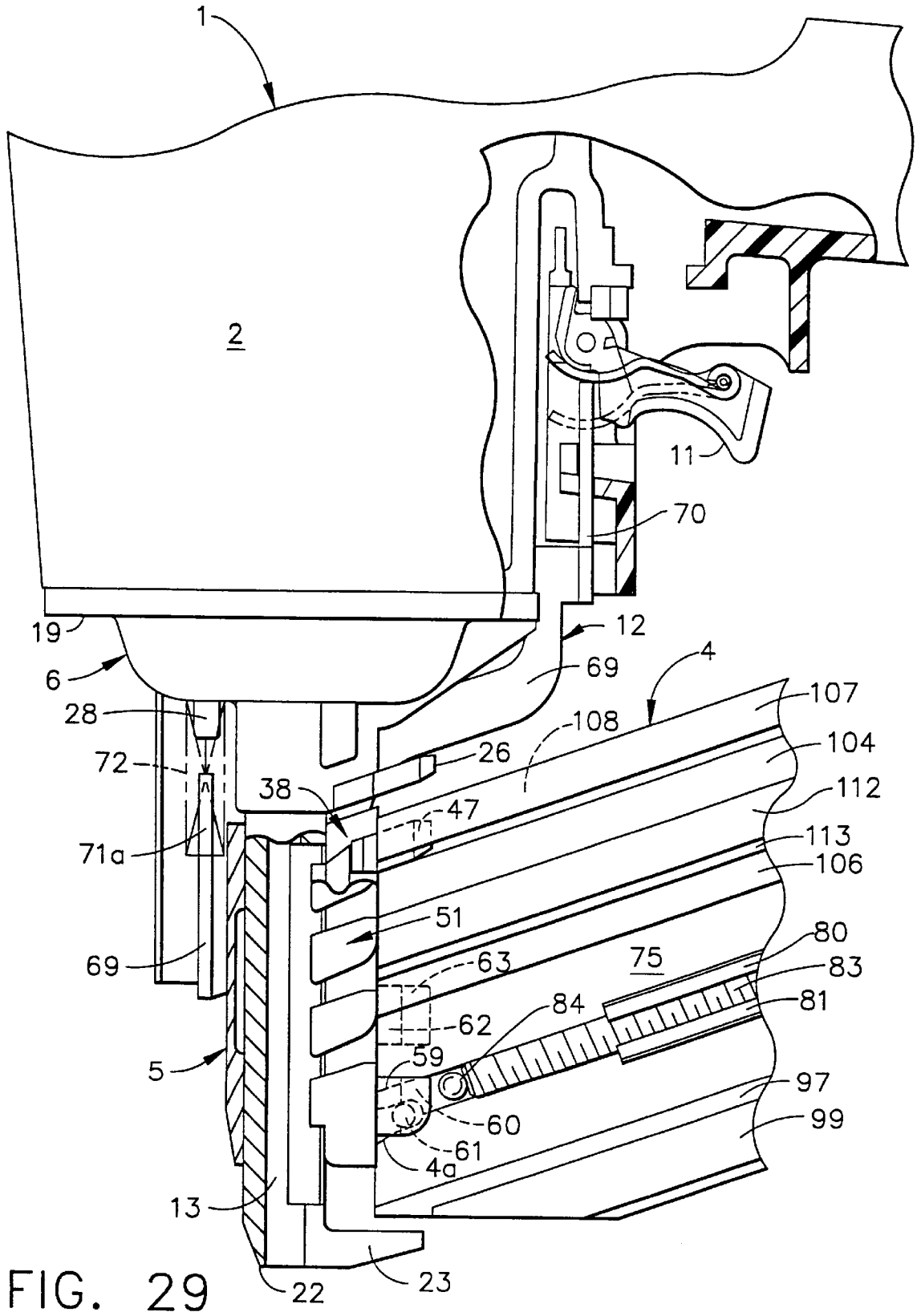
FIG. 29 is a fragmentary side elevational view, partly in cross-section, similar to FIG. 28, and illustrating the magazine attached to the slide assembly.

FIG. 29 is similar to FIG. 28, but shows the magazine 4 in place. The magazine 4 is attached to the slide assembly by means of the lug 47 of the left slide retainer 38 entering the socket 108 of magazine 4 (see also FIG. 22). In addition, the lug 62 of the right slide retainer lies along the exterior of magazine side wall 75. The lug 59 of right slide retainer 51 is located along the inside surface of magazine side wall 75. The transversely directly cylindrical lug 61, constituting a part of lug 59, is received in the slot 4*a* of magazine 4. As a consequence, the lugs 62 and 59 prevent transverse or side-to-side motion of the magazine with respect to the slide assembly. In a similar fashion, the cylindrical lug 61, together with lug 47, preclude vertical shifting (as viewed in FIG. 29) of the magazine 4 with respect to the slide assembly.

Reference is now made to FIG. 1. It will be remembered that the cover 7 has a slot 162 (see FIG. 22) in which the lug 26 of guide body 5 is engaged. This rigidly and removably attaches the forward end of cover 7 to the guide body. Near its rearward end, (as viewed in FIG. 1) the cover is provided with a bracket 8 which is bolted in place through cover perforations 163 and 164 (see FIGS. 21 and 22), by bolts 165 and 165*a*. The rearward end of handle portion 3 of Tool 1 is provided with a downwardly depending extension 9 which supports a stud 170. The mounting plate 8 is provided with a slot 171 having a circular end 171*a*, an intermediate narrow portion 171*b*, and a circular end 171*c* of lesser diameter than circular 171*a*. When the magazine 4 and its cover 7 are assembled, they are positioned so that the stud 170 enters the circular end 171*a* of plate 8. As magazine 4 and magazine cover 7 are shifted forwardly to engage magazine 4 with the various slide retainer lugs described above and to engage the magazine cover 7 with the guide body lug 26, the stud of extension 9 will shift through the intermediate slot portion 171*b* into the circular slot portion 171*c*. The stud is thereafter tightened by knob 172. In this manner, the magazine cover 7 is rigidly mounted to the tool and the magazine 4 is affixed to the slide assembly.

In FIGS. 1, 22, 28 and 29, the slide 5 and magazine 4 are shown at or near their uppermost positions. In phantom lines, the tips of the nails 15 of strip 14 of FIG. 1 are shown in their positions when the magazine and the slide assembly are in their lowermost positions, as determined by abutment of the slide assembly against rearward extensions 23 and 24 of guide body 6. It will be noted that the first and second nails 15 of row 14 extend well below the nose 22 of guide body 6.

The present invention having been described in detail, the manner of its use may now be set forth. The magazine 4 and magazine cover 7 are assembled and are affixed to the tool 1 in the manner just described. A strip of nails is inserted in the magazine 4 from the rearward end thereof. Since the magazine 4 and the magazine cover 7 have substantially corresponding slots in their left sides, the strip of nails may be easily shifted manually beyond the end 131 of spring tine 126. Assuming that the feeder shoe 18 is in a forward position as the result of previous nailing operation, the feeder clip 136 thereof may be pivoted so that its lugs 141–144 do not contact the strip of nails. This is accomplished by feeder clip handle 140. When feeder clip handle 140 is depressed inwardly of magazine 4, the feeder shoe may be pulled rearwardly over the strip of nails to a position behind the strip of nails. Upon release of handle 40, the feeder clip 136 will engage the last nail of the strip and the rearwardly directed lug of the feeder clip will engage the rachet 83. Since the feeder shoe is spring biased toward the guide body, the feeder shoe will urge the forwardmost nail of the strip (or any nails remaining from a previous strip) forwardly to put the forwardmost nail in the drive track.

It will be remembered that the safety 12, the slide 5 and its retainers 38 and 51, and the magazine 4 constitute an integral, multi-piece structure since both the safety 12 and the magazine 4 are attached to the slide assembly. By reason of safety compression spring 72, the safety is normally urged to its lower position and the trigger 11 is disabled. At the same time, the spring 72 causes slide assembly to normally rest in its lowermost position against guide body extensions 23 and 24 and as a consequence, magazine 4 will be in its lowermost position within magazine cover 7 so that the row of nails will assume the position shown in phantom lines in FIG. 1. This is the normal, unactuated state of tool 1.

To attach a first workpiece (such as a bracket or the like) to a second workpiece by driving a nail through a pre-formed hole in the first workpiece, it is necessary to align the drive track 13 of the tool with the pre-formed hole in the first workpiece. This is easily accomplished since, as is shown in phantom lines in FIG. 1, when the tool is in its normal unactuated state, the forwardmost nail extends below the guide body nose 22 and can readily serve as a hole locating probe.

Once the forwardmost nail has located the pre-formed hole in the first workpiece, the tool is pressed toward the first workpiece. The forwardmost nail will bottom against the second workpiece within the pre-formed hole in the first workpiece and will cause the slide assembly, magazine 4 and the safety 12 to move upwardly (as viewed in FIG. 1) to their upper positions wherein trigger 11 is enabled by safety 12 and the tool is ready to be actuated by trigger 11 to drive the forwardmost nail through the pre-formed hole in the first workpiece and into the second workpiece.

It will be noted that when the slide assembly, the magazine 4 and the safety 12 are in their upper position as shown in solid lines in FIG. 1, the end of the forwardmost nail still extends below the guide body nose 22 by a small amount. Thus, the forwardmost nail will remain in the pre-formed hole assuring that the drive track 13 remains aligned with the pre-formed hole at initiation of tool actuation.

In an instance where the first workpiece is of such thickness that the forwardmost nail of the row cannot bottom against the second workpiece to cause the slide assembly, the magazine 4 and the safety 12 to shift to their upper positions, the second nail will abut the outer surface of the first workpiece and cause these elements to shift to their upper positions. When the tool is pulled away from the workpiece, and the trigger 11 is released, the tool will return to its normal state, the safety spring 72 causing the slide assembly, the safety 12 and the magazine 4 to return to their lower positions.

Since the magazine 4 and the nail head guide 115 slope upwardly and rearwardly when tool 1 is in the position shown in FIG. 1, there is a tendency for the strip of nails to shift rearwardly when the magazine 4 shifts from its lowermost position to its uppermost position. This shift, however, is precluded by the engagement of the rachet 83 by rearwardly directed feeder clip lug 144.

As the nails of the strip are depleated and the feeder shoe shifts forwardly, the feeder shoe nose 18*a* will finally pass beneath the nail stop 25 of guide body 6. This occurs when a nail, such as the fourth nail from the strip rearward end enters the drive track. As a result the feeder shoe 18 cannot move upwardly and prevents upward movement of the sleeve, the magazine and the safety so that the trigger 11 is not enabled and the tool cannot be actuated. This will preclude the possibility of a "dry" actuation of the tool (i.e., actuation of the tool with no nail in the drive track).

In the above description, and in the claims, it will be understood that words such as "upperwardly", "downwardly", "forwardly", "rearwardly", and the like are used in conjunction with the drawings. It will be appreciated by one skilled in the art that during a nailing operation, the tool 1 can be held in various orientations.

Modifications may be made in the invention without departing from the spirit of it.

What is claimed:

1. A fastener driving tool capable of locating a preformed hole in a first workpiece and driving a fastener therethrough into a second workpiece, said tool comprising a body having a main body portion and a handle portion, a guide body affixed beneath said main body portion and terminating in a nose portion, a drive track in said guide body, a driver axially shiftable in said drive track to drive a fastener therefrom, a trigger actuated mechanism in said main body portion to shift said driver, a fastener magazine having a rearward end and having a forward end in communication with said drive track, a row of fasteners in said magazine joined together to form a strip of fasteners, a feed mechanism constantly urging the forwardmost fastener of said strip into said drive track, and a trigger enabling safety operatively connected to said magazine, said magazine being shiftable with respect to said tool body and guide body in directions parallel to the axis of said drive track between a first position wherein said forwardmost fastener of said strip extends below said guide body nose and constitutes a hole finding probe to find said first workpiece hole and a second position wherein said safety enables said trigger and said drive track is aligned with said first workpiece hole and said tool is ready to drive said forwardmost fastener through said first workpiece hole into said second workpiece.

2. The fastener driving tool claimed in claim 1 including a slide assembly captively mounted on said guide body, said slide assembly being shiftable on said guide body in directions parallel to the axis of said drive track, said magazine forward end being removably affixed to said slide assembly and being supported thereby and shiftable therewith between said first and second positions, said slide and magazine being spring biased to said first position of said magazine.

3. The fastener driving tool claimed in claim 2 wherein said safety is attached to said slide and is shiftable with said slide and said magazine between a normal position when said magazine is in said first position and a trigger enabling position when said magazine is in said second position.

4. The fastener driving tool claimed in claim 2 wherein said fasteners are headed nails and said tool comprises a pneumatically actuated tool.

5. The fastener driving tool claimed in claim 4 including a compression spring having one end seated on said guide body and one end seated on said safety, said compression spring constantly urging said safety to its normal position and said magazine to said first position via said slide.

6. The fastener driving tool claimed in claim 5 including an elongated nail head guide having a channel formed therein configured to guide and support the heads of said nail strip, said nail head guide being mountable at at least two different levels within said magazine to accommodate strips of nails of different shank lengths.

7. The fastener driving tool claimed in claim 6 wherein said safety is attached to said slide and is shiftable with said slide and said magazine between a normal position when said magazine is in said first position and a trigger enabling position when said magazine is in said second position.

8. The fastener driving tool claimed in claim 7 including a compression spring having one end seated on said guide body and one end seated on said safety, said compression spring constantly urging said safety to its normal position and said magazine to said first position via said slide.

9. The fastener driving tool claimed in claim 8 including an elongated hollow cover for said magazine, said cover being sized to enable said magazine to shift therein between its first and second positions, said cover having forward and rearward ends, said cover being rigidly and removably affixed at its forward end to said guide body and rigidly and removably attached to said tool handle portion.

10. The fastener driving tool claimed in claim 9 wherein said magazine is shiftable to said second position against the action of said compression spring by one of the first and second nail in said strip when said tool is pressed toward said first workpiece.

11. The fastener driving tool claimed in claim 10 wherein said magazine comprises an elongated hollow member having a top, a bottom and first and second side walls, said first side wall having a slot extending longitudinally thereof dividing said first wall into upper and lower first wall portions, parallel, spaced, opposed channels being formed on said upper and lower first wall portions, a feeder shoe having a body slidably engaged in said channels and spring biased toward said guide body, a pivot pin mounted in said feeder shoe body, a feeder clip pivotally mounted on said pivot pin, said feeder clip having forwardly directed lugs adapted to engage the rearwardmost nail of said strip urging the rearmost nail and the strip forwardly and locating the forwardmost nail in the drive track, and elongated ratchet member mounted on the inside surface of said second wall, said feeder clip having a rearwardly directed lug normally engaging said ratchet member to preclude movement of said strip of nails away from said guide body when said magazine is shifted from said first to said second position, said feeder clip being spring biased to a nail and ratchet engaging position, said feeder clip having a handle, said feeder clip being pivotable by said handle from said nail and ratchet engaging position to a nail and ratchet disengaging position whereby to allow said feeder shoe to pass over said strip of nails during placement of said feeder shoe behind said strip and to allow said strip of nails to pass beneath said feeder shoe for removal from said magazine.

12. The fastener driving tool claimed in claim 11 wherein said guide body has a rearwardly directed lug, a notch formed in said slide to clear said lug, said feeder shoe body having a nose portion configured to pass beneath said lug to preclude upward movement of said feeder shoe, said magazine and said safety, said lug being positioned to prevent driving of the last few nails of said strip, whereby to prevent dry actuation of said tool.

13. The fastener driving tool claimed in claim 12 wherein said ratchet comprises a rod of circular cross-section provided with a fine thread.

14. The fastener driving tool claimed in claim 1 including an elongated hollow cover for said magazine, said cover being sized to enable said magazine to shift therein between its first and second positions, said cover having forward and rearward ends, said cover being rigidly and removably affixed at its forward end to said guide body and rigidly and removably attached to said tool handle portion.

15. The fastener driving tool claimed in claim 1 wherein said magazine is biased to said first position, said magazine being shiftable to said second position by one of the first and second fasteners of said strip when said tool is pressed toward said first workpiece.

16. The fastener driving tool claimed in claim 1 wherein said magazine comprises an elongated hollow member having a top, a bottom and first and second side walls, said first side wall having a slot extending longitudinally thereof dividing said first wall into upper and lower first wall portions, parallel, spaced, opposed channels being formed on said upper and lower first wall portions, a feeder shoe having a body slidably engaged in said channels and spring biased toward said guide body, a pivot pin mounted in said feeder shoe body, a feeder clip pivotally mounted on said pivot pin, said feeder clip having forwardly directed lugs adapted to engage the rearwardmost fastener of said strip urging the rearmost fastener and the strip forwardly and locating the forwardmost fastener in the drive track, and elongated ratchet member mounted on the inside surface of said second wall, said feeder clip having a rearwardly directed lug normally engaging said ratchet member to preclude movement of said strip of fasteners away from said guide body when said magazine is shifted from said first to said second position, said feeder clip being spring biased to a fastener and ratchet engaging position, said feeder clip having a handle, said feeder clip being pivotable by said handle from said fastener and ratchet engaging position to a fastener and ratchet disengaging position whereby to allow said feeder shoe to pass over said strip of fasteners during placement of said feeder shoe behind said strip, and to allow said strip of fasteners during placement of said feeder shoe for removal from said magazine.

17. The fastener driving tool claimed in claim 5 wherein said ratchet comprises a rod of circular cross-section provided with a fine thread.

18. The fastener driving tool claimed in claim 1 wherein said tool is a pneumatically actuated tool.

19. The fastener driving tool claimed in claim 1 wherein said fasteners comprise nails.

20. The fastener driving tool claimed in claim 1 wherein said fasteners comprise headed nails joined together in said strip with the head of each nail partially overlapping the head of the preceding nail.

21. The fastener driving tool claimed in claim 1 wherein said guide body has a rearwardly directed lug, a notch formed in said slide to clear said lug, said feeder shoe body having a nose portion configured to pass beneath said lug to preclude upward movement of said feeder shoe, said magazine and said safety, said lug being positioned to prevent driving of the last few fasteners of said strip, whereby to prevent dry actuation of said tool.

22. The fastener driving tool claimed in claim 1 wherein said magazine has first and second side walls, a top, a bottom and open forward and rearward ends, said magazine cover having first and second side walls, a top, a bottom and open forward and rearward ends, said magazine cover being sized to receive said magazine therein and to permit said magazine to shift therein between said first and second positions, a pair of guide posts affixed to the exterior of said second side wall of said magazine and extending through elongated slots in said second side wall of said magazine cover, said elongated slots and said guide posts being configured to assure that said shifting of said magazine is parallel to said axis of said drive track.

* * * * *